US005711401A

United States Patent [19]

Rchid

[11] Patent Number: 5,711,401

[45] Date of Patent: Jan. 27, 1998

[54] SAFETY PROTECTION MEANS FOR METAL SCAFFOLDS ESPECIALLY WITH JOINTS OF VARIABLE GEOMETRY

[76] Inventor: Abazid Amin Rchid, Via Liguria, 11, 50145 Firenze, Italy

[21] Appl. No.: 681,918

[22] Filed: Jul. 29, 1996

[30] Foreign Application Priority Data

Jul. 31, 1995 [IT] Italy ..... FI950078 U

[51] Int. Cl.[6] ..... E04G 1/00

[52] U.S. Cl. ..... 182/129; 403/23

[58] Field of Search ..... 182/129, 178, 182/179; 403/23, 384, 385, 388, 389

[56] References Cited

U.S. PATENT DOCUMENTS 4,605,332 8/1986 Mayhew et al. ..... 403/23

4,610,559 9/1986 Mayhew et al. ..... 403/23

4,890,948 1/1990 Edi Bondioli ..... 403/23

*Primary Examiner*—Alvin C. Chin-Shue

*Assistant Examiner*—Long Dinh Phan

*Attorney, Agent, or Firm*—McGlew and Tuttle

[57] ABSTRACT

A safety protection device for joints, that is knots, of metal scaffolds, especially of a variable geometry type, made up of two caps which are disposed with slight clearance on opposite sides with respect to the center line (a-a) of the joint. Each safety protection device is made up of two bodies each having two facing semicircular recesses so as to delimit, in use, two facing chambers. The chambers are for housing corresponding parts or portions of the joint. Two circular holes are provided for the passage of two tubes connected by the joint. The parts of each one of the caps is connectable to each other in a fixed but removable way.

4 Claims, 3 Drawing Sheets

SAFETY PROTECTION MEANS FOR METAL SCAFFOLDS ESPECIALLY WITH JOINTS OF VARIABLE GEOMETRY

FIELD OF THE INVENTION

The present invention refers to a protection and safety means for metal scaffolds, especially with joints of variable geometry.

BACKGROUND OF THE INVENTION

It is known to those skilled in the art that when mounting metal scaffolds, the joints with variable geometry are mostly used to connect tubes which are not orthogonal to each other, that is, with the respective axes forming an angle other than 90°, for building elements such as stairs and service banisters or handrails, or for mounting bases for scaffolds resting on sloping grounds.

It is also known that, in use, the joints with variable geometry, as well as the traditional joints, exhibit outwardly protruding parts which put at serious risk the safety of operators and passers-by. For this reason, the joints of metal scaffolds, especially those located at a predetermined level from the ground, are sheathed with tape of plastic material, so as to cover the said protruding parts.

However, this procedure is hardly effective, both for the poor protection provided and the long time spent for carrying out the covering of each joint.

SUMMARY AND OBJECTS OF THE INVENTION

The main object of the present invention is to overcome the above said drawbacks. This result has been achieved, according to the invention, by adopting the idea of making a protective means for joints of two caps which are disposed with a slight clearance on metal scaffolds, particularly of variable geometry, including opposite sides with respect to a center line of the joint. Each of the caps is in turn made up of two bodies. Each of the bodies have two facing semicircular recesses so as to delimit, in use, two facing chambers for housing corresponding parts or portions of the joint. Two circular holes are provided for the passage of two tubes connected by the joint. Parts of each one of the caps is connectable to each other in a fixed but removable way.

The caps preferably are formed to be substantially identical. Each of the caps may be obtained by injecting artificial plastic material into suitable molds or mold impressions. According to the invention, the connection of the two parts of each of the caps is achieved by pins in corresponding bushes defined and delimited by the same parts or otherwise by screw means or tightening straps or by a fixed coupling.

The variable geometry joint comprises two jaw-like bodies intended to clamp the corresponding tubes of the scaffolding by means of bolts and respective tightening nuts. The two bodies of the joint are connected to each other by a transverse pivot to allow for a relative rotation thereof. This allows the orientation of the tubes according to the desired geometry.

The advantages deriving form the present invention lie essentially in that it is possible to make the scaffold joints, especially those of variable geometry type, much safer and, at the same time, capable of covering and protecting them from the action of the atmospheric agents and of materials used in the construction of buildings with the use of scaffolds; that a protection and safety means according to the invention is easy to make, cost-effective, reliable even after a prolonged service life, of general application and reusable many times.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1:
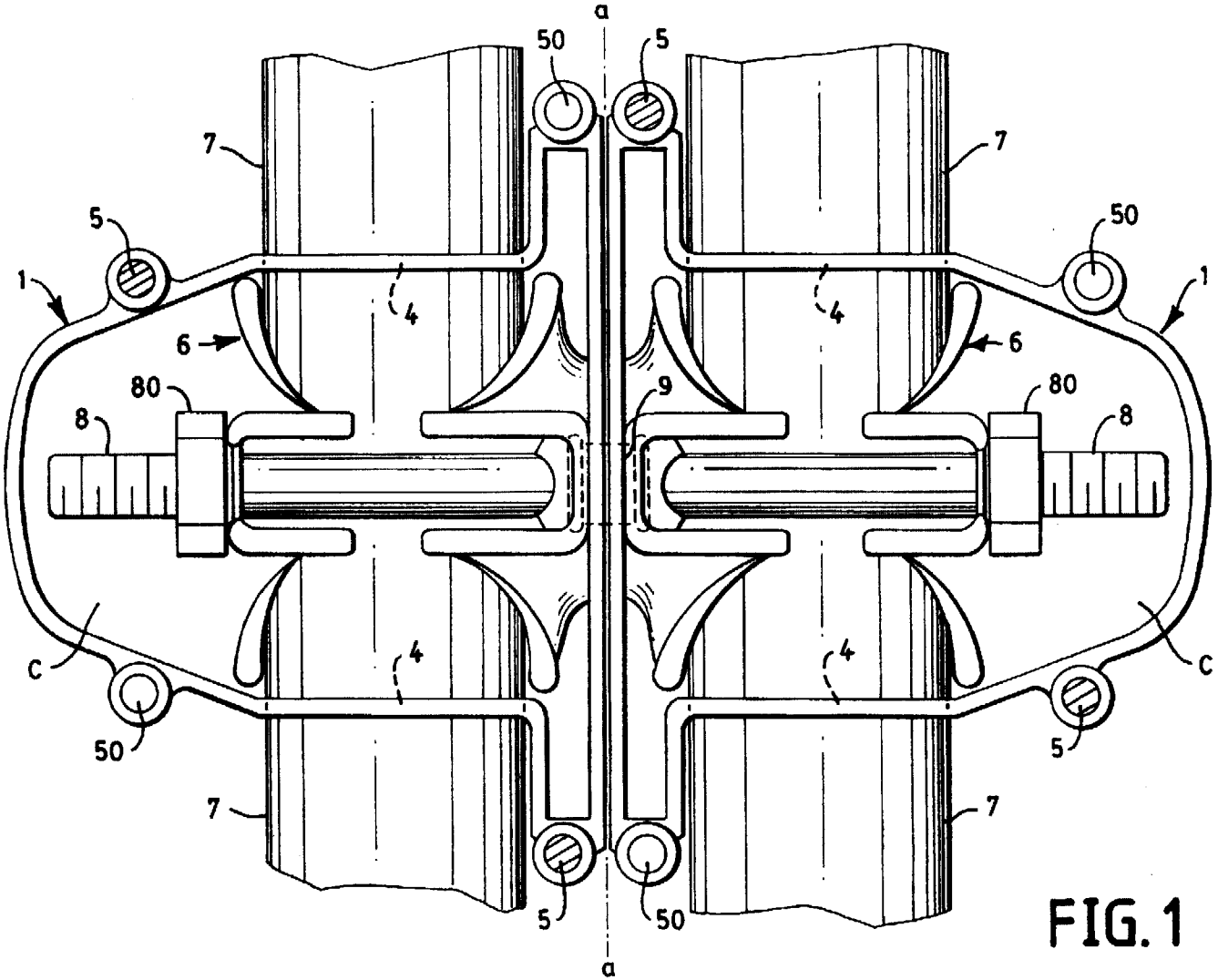
FIG. 1 shows schematically a view in longitudinal section of a protection and safety means according to the invention, in operative condition, with a variable geometry joint which connects two tubes having parallel axes.

Reduced to its basic structure, and reference being made to the figures of the attached drawings, a protection and safety means for joints of metal scaffolds according to the invention is made up of two like caps (1) disposed with a slight clearance on opposite sides with respect to the center line (a-a) of the joint and each of which being, in turn, made up of two bodies (2, 3) each having two facing semicircular recesses (4) so as to delimit, in use, two facing chambers (C) for housing corresponding parts or portions of the joint and two circular holes for the passage of two tubes (7) connected by the joint: said parts (2, 3) of each one of said caps (1) being connectable to each other in a fixedly but removably way. Each of said caps (1) is obtainable, for example, by injection of artificial plastic material within moulds or mould impressions reproducing the shape of the respective parts (2) and (3).

The connection between the two parts (2, 3) of each of said caps (1) may be accomplished, by way of example and with reference to the figures of the attached drawings, by pins (5) and corresponding bushes (50) of the same parts (2, 3).

Alternatively, said connection may be accomplished by using screw means or straps for clamping the concerned parts, as well as flexible tongues and/or projections and corresponding recesses of parts (2, so as to allow for a fixed coupling. The parts (2, 3) of caps (1) may also be provided with internal seats or cavities to allow for a direct engagement thereof with one or more parts or portions of the joint. The above said alternate means for connecting the parts (2, 3) of caps (1) are not shown in the figures of the attached drawings for the sake of clarity.

Figure 2:
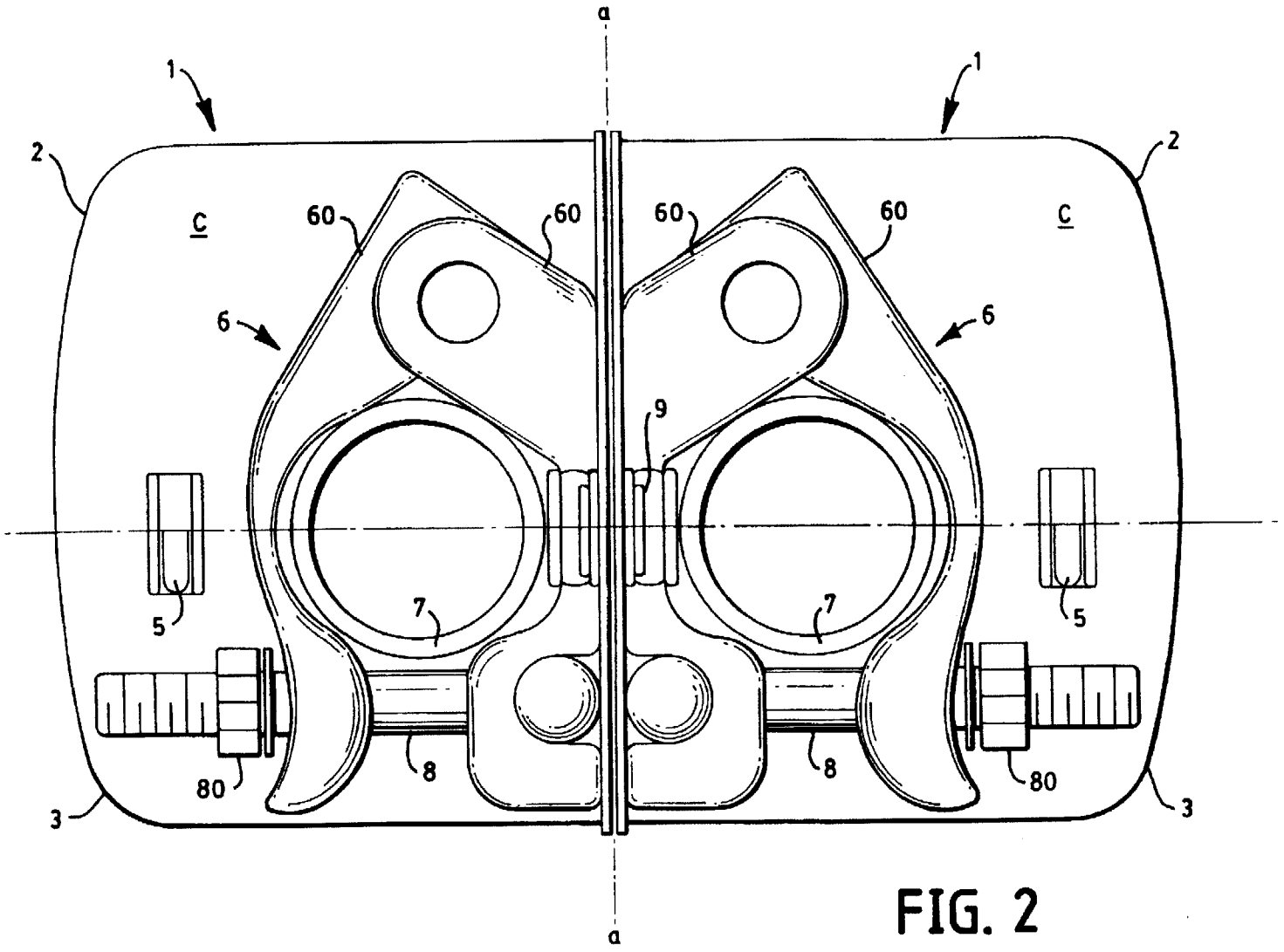
FIG. 2 shows schematically a cross-sectional view of the means in FIG. 1.

FIGS. 1 and 2 show, by way of non limiting example, a protection and safety means according to the invention, which is associated to a variable geometry joint comprising two jaw-like bodies (6) intended to clamp the corresponding tubes (7) of the scaffold by means of bolts (8) and respective tightening nuts (80), the two bodies (6) of the joint being connected to each other by a transversal pivot (9) to allow for the relative rotation thereof, so as to orient the two tubes (7) according to the desired geometry.

It will be appreciated that the variable geometry joint may be of any type available on the market and constructionally different from the one above described, as the present protection and safety means is of universal application.

The protection and safety means above described is used as follows.

Figure 3:
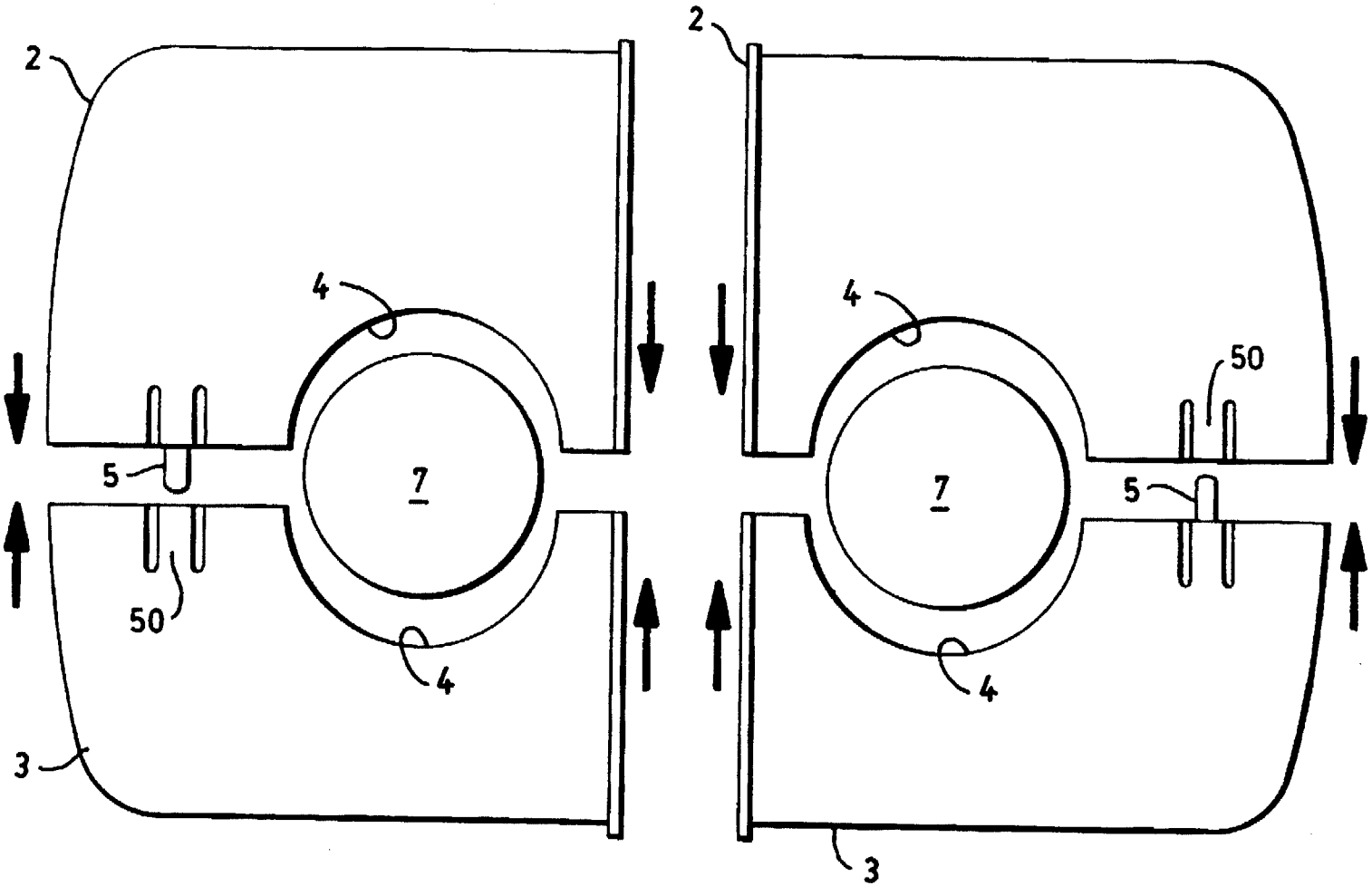
FIG. 3 shows schematically an exploded cross-sectional view of a protection and safety means according to the invention.

After having mounted the joint, that is, after having connected the tubes (7) through the joints, the parts (2, 3) of the caps still unassembled are disposed around the tubes (7) as shown in FIG. 3.

At this point, the detached parts (2, 3) of each cap (1) are tightened so as to have the tubes (7) passing through the respective holes delimited by the recesses (4) (see arrows of FIG. 3). The mutual connection of the two parts (2, 3) of each cap is obtained by coupling each pin (5) with the respective bush (50). The provision of said clearance between the two caps (1) makes it possible to prevent any interference between them, so that the tubes (7) can be oriented in any direction without limiting the protection capacity thus accomplished.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present.

I claim:

1. A safety protection device for joints of metal scaffolds, comprising:

two caps which are disposed with slight clearance on opposite sides with respect to a center line of the joint, each of said two caps including two bodies, each of said bodies having two facing semicircular recesses defining two facing chambers for housing corresponding parts or portions of the joint and two circular holes for the passage of two tubes connected by the joint, said bodies of each one of said caps being connectable to each other in a fixed but removable way by connection means, said connection means including at least one of pins and corresponding bushes defined and delimited by said bodies, screw means, tightening straps and a fixed coupling.

2. The device according to claim 1, wherein said caps are substantially equal in size.

3. The device according to claim 1, wherein each of said caps is obtained by injecting artificial plastic material into suitable moulds or mould impressions.

4. A safety protection device for joints of metal scaffolds in combination with a variable geometry joint, the combination comprising:

a variable geometry joint with two jaw-like bodies intended to clamp the corresponding tubes of the scaffold by means of bolts and respective tightening nuts, said two jaw-like bodies of the joint being connected to each other by a transversal pivot to allow for the relative rotation thereof, so as to orient the two tubes according to the desired geometry; and two caps which are disposed with slight clearance on opposite sides with respect to a center line of the joint, each of said two caps including two bodies, each of said bodies having two facing semicircular recesses defining two facing chambers for housing corresponding parts or portions of the joint and two circular holes for the passage of two tubes connected by the joint, said bodies of each one of said caps being connectable to each other in a fixed but removable way by connection means, said connection means including at least one of pins and corresponding bushes defined and delimited by said bodies, screw means, tightening straps and a fixed coupling.

* * * * *